US006683420B2

(12) United States Patent
Bens et al.

(10) Patent No.: US 6,683,420 B2
(45) Date of Patent: Jan. 27, 2004

(54) SWITCHING DEVICE FOR OPERATING A HIGH-PRESSURE DISCHARGE LAMP

(75) Inventors: Petrus Wilhelmus Fransiscus Bens, Oss (NL); Franciscus Hubertus Theodorus Lammers, Oss (NL)

(73) Assignee: Koninklijke Philips Electronics N.V., Eindhoven (NL)

( * ) Notice: Subject to any disclaimer, the term of this patent is extended or adjusted under 35 U.S.C. 154(b) by 0 days.

(21) Appl. No.: 09/931,207

(22) Filed: Aug. 16, 2001

(65) Prior Publication Data

US 2002/0101183 A1 Aug. 1, 2002

(30) Foreign Application Priority Data

Aug. 17, 2000 (EP) ..... 002028868

(51) Int. Cl.[7] ..... H05B 37/00

(52) U.S. Cl. ..... 315/226; 315/246; 315/291; 315/307

(58) Field of Search ..... 315/226, 360, 315/209 R, 291, 307, DIG. 5, DIG. 7, 246, 308

(56) References Cited

U.S. PATENT DOCUMENTS 4,812,736 A * 3/1989 Albach et al. ..... 323/224
5,608,294 A * 3/1997 Derra et al. ..... 315/224
5,808,561 A * 9/1998 Kinoshita et al. ..... 315/209 R
5,909,089 A * 6/1999 Deurloo et al. ..... 315/224
5,925,989 A * 7/1999 Blankers ..... 315/209 R
6,028,397 A * 2/2000 Blankers ..... 315/209 R
6,127,789 A * 10/2000 Ishizuka et al. ..... 315/308
6,278,245 B1 * 8/2001 Li et al. ..... 315/224

FOREIGN PATENT DOCUMENTS

| | | | |
|---|---|---|---|
| EP | 0415490 A2 | 8/1990 | ..... H02M/7/5387 |
| EP | 0843505 A1 | 11/1996 | ..... H05B/41/29 |
| JP | 11-214188 * | 8/1999 | |
| WO | WO0036882 | 12/1999 | ..... H05B/41/292 |

* cited by examiner

*Primary Examiner*—Don Wong
*Assistant Examiner*—Thuy Vinh Tran

(57) ABSTRACT

A switching device for operating a high-pressure discharge lamp with a voltage having successive periods of opposite polarity. The switching device includes input terminals for connecting a power supply source, output terminals for connecting the discharge lamp, a switch mode power supply and a control circuit for controlling the switch mode power supply, and a device for forming a lamp signal corresponding to the voltage present across the lamp. The switching device is provided with an arrangement for detecting a direct current through and/or a DC voltage across the high-pressure discharge lamp.

26 Claims, 2 Drawing Sheets

SWITCHING DEVICE FOR OPERATING A HIGH-PRESSURE DISCHARGE LAMP

BACKGROUND OF THE INVENTION

This invention relates to a switching device for operating a high-pressure discharge lamp with a voltage having successive periods of opposite polarity, comprising:

input terminals for connecting a power supply source, output terminals for connecting the lamp to be operated, a switch mode power supply and control means for controlling the switch mode power supply, and means to form a lamp signal corresponding to the voltage across the lamp.

The invention also relates to a projection apparatus comprising a switching device which can suitably be used to operate a high-pressure discharge lamp.

A switching device of the type mentioned in the opening paragraph is known from WO 00/36882 (D98161) which corresponds to U.S. Pat. No. 6,232,725 which is hereby incorporated by reference into this application. The known switching device comprises means which enable the power supplied to the lamp to be controlled by means of a microprocessor in such a way that the shape of the current through the lamp can be adjusted for each period of the supply_ voltage having successive periods of opposite polarity. The shape of the current flowing through the lamp is adjusted on the basis of the lamp signal corresponding to the voltage across the lamp. In this manner, flicker and unstable burning of the lamp can be substantially counteracted. The known switching device can particularly suitably be used to operate a high-pressure discharge lamp in a projection system, such as a projection television receiver.

A drawback of the known switching device, however, is that it is very complex and, in addition, offers no protection against failure of the lamp as a result of, for example, asymmetric operation of the lamp over a long period of time.

SUMMARY AND OBJECTS OF THE INVENTION

It is an object of the invention to provide a measure to counteract said drawback. This is achieved by means of a switching device of the type mentioned in the opening paragraph, which is characterized in accordance with the invention in that the switching device comprises means for detecting a Direct current through or a DC voltage across the high-pressure discharge lamp.

An advantage of the switching device in accordance with the invention resides in that undesirable, long-term asymmetry in the operation of the lamp can be detected in a comparatively simple way. Asymmetric operation of the lamp is based on the fact that the lamp effectively carries a DC voltage and/or a Direct current over a length of time covering at least two successive periods of opposite polarity. The detection of a Direct current through or a DC voltage across the high-pressure discharge lamp preferably takes place by means of the lamp signal. This has the advantage that the complexity of the switching device remains limited.

In an advantageous embodiment of the switching device in accordance with the invention, the formation of the lamp signal relates to time-sequential voltage detections, and the means for carrying out the detection include comparison means for comparing successive voltage detections. In this manner, a voltage difference between successive voltage detections can be advantageously established.

Preferably, the switching device is provided with a commutator (i.e. DC/AC converter) as in U.S. Pat. No. 6,232,725 that converts a DC current into an alternating current having successive periods of opposite polarity, and the lamp signal is formed between the output of the switch mode power supply and said commutator. This has the important advantage that improper functioning of the commutator is also detected. Improper functioning of the commutator, in general as a result of improper switching of one of the commutator switches, is an important cause of Direct current or DC voltage operation of the lamp. The possibility of monitoring the proper functioning of the commutator by means of thermal detection is impracticable, taking into consideration the fact that a commutator in a switching circuit for a high-pressure discharge lamp often comprises 4 switching elements, because this thermal detection would require at least 2, but preferably 4, thermal detection circuits, which would result in a very complex procedure.

In an advantageous embodiment of the switching device, the detection means can be used to carry out an algorithm wherein, after each voltage detection, a counting register is controlled on the basis of the outcome of a comparison between the established voltage difference and an average voltage and, upon the counting register exceeding a threshold value, a control signal is generated for switching the switch mode power supply to a stand-by mode.

Surprisingly, it has been found that as regards the successive voltage detections, a voltage detection in each period of the successive periods of opposite polarity is sufficient. As a result, the switching device remains comparatively simple. If the lamp signal to be detected contains comparatively much noise, then it may be advantageous to employ a filter circuit in the switching device, for example in the form of an analog low-pass filter. Another possible filter technique is a digital filter technique, for example for averaging out 2 or more voltage detections per period of the successive periods of opposite polarity.

Preferably, the average voltage is formed from a moving average of voltage detections in the last 4 successive periods of opposite polarity. This has the important advantage that the average voltage, which is used as a reference value, is related to each individual lamp. As a result, a spread in properties between individual lamps has no appreciable effect on the reliable functioning of the switching device.

In experiments it has been found that if the established voltage difference exceeds 50% of the average voltage, then this voltage difference can be used as a measure of the occurrence of a Direct current through or a DC voltage across the lamp. In such a case, an increase of the counting register by one enables the frequency of the direct current flowing through or the DC voltage applied across the lamp to be monitored. Preferably, the counting register is reduced by one if the established voltage difference is equal to or smaller than 50% of the average voltage. In this manner, the influence of accidental fluctuations in the current through or the voltage across the lamp is substantially eliminated in a simple, reliable manner.

BRIEF DESCRIPTION OF THE DRAWINGS

These and other aspects of the invention will be apparent from and elucidated with reference to the embodiment(s) described hereinafter.

In the drawings:

FIG. 1 shows a switching device which is suitable for operating a high-pressure discharge lamp LA with a voltage having successive periods of opposite polarity, wherein K1, K2 are input terminals for connecting a power supply source, and L1, L2 are output terminals for connecting the high-pressure discharge lamp LA to be operated. The lamp can be a part of a projection system 10. I represents a switch mode power supply, II represents a commutator for applying an alternating voltage to the lamp LA and III represents control means for controlling the switch mode power supply and the commutator. The switching device further comprises means VD for forming a lamp signal corresponding to the voltage across the lamp. The switching device also comprises means DCM for detecting a Direct current through or a DC voltage across the high-pressure discharge lamp.

The means VD for forming the lamp signal are connected to a connection point L3 between the output of the switch mode power supply and the commutator. As a result, the lamp signal is formed as a voltage detection at the output of the switch mode power supply. The control means III controls the alternating voltage to the discharge lamp LA as a function of the lamp signal.

In a practical embodiment of the switching device in accordance with the example described hereinabove, this switching device can suitably be used to operate a lamp of the type UHP132W, manufactured by Philips. The commutator comprises 4 MOSFET switches, which are rendered conducting and non-conducting in pairs at regular intervals of time. In the above-described example, switching of the commutator switches takes place at a constant frequency, for example 90 Hz. Alternatively, the switching of the commutator is synchronized with a video signal from the projection system by means of a control signal. The switch mode power supply is a Buck converter or (step-) down converter provided with a switching element which is rendered conducting and non-conducting with a high frequency by a control signal originating from the control means, for example a PWM. The Buck converter or (step-) down converter may be preceded by a boost converter or (step-) up converter. A resistive voltage divider which is connected to the connection point L3 forms part of the means VD for forming a lamp signal corresponding to the voltage across the lamp. The part of the means VD which forms the lamp signal as time-sequential voltage detections, in the case described, of the voltage at a tap on the resistive voltage divider, forms part of a programmable IC 80C51 of the type 83747, manufactured by Philips. The programmable IC, which is provided with an algorithm as described hereinbelow, also forms the means DCM for detecting a direct current through or a DC voltage across the high-pressure discharge lamp. The IC also forms part of the control means III. The means DCM are responsible for periodically comparing successive voltage detections.

For a counting register use is made of a RAM memory accommodated in the IC. In the practical example, the switch mode power supply is switched to a standby mode as soon as the counting register reaches 750. In the standby mode of the switch mode power supply, the control means make sure that the voltage at the output of the switch mode power supply is so low that a discharge cannot be maintained in the lamp.

Figure 1:
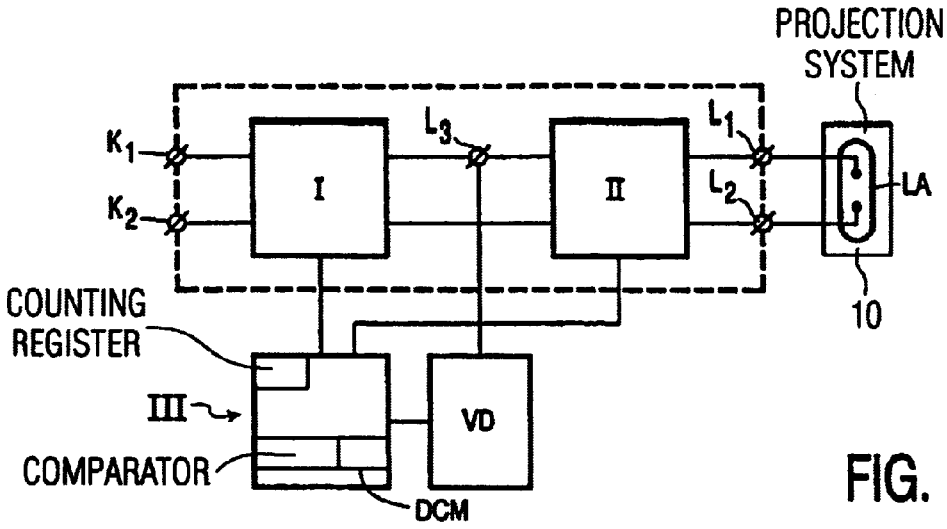
FIG. 1 diagrammatically shows a switching device in accordance with the invention.
Figure 2:
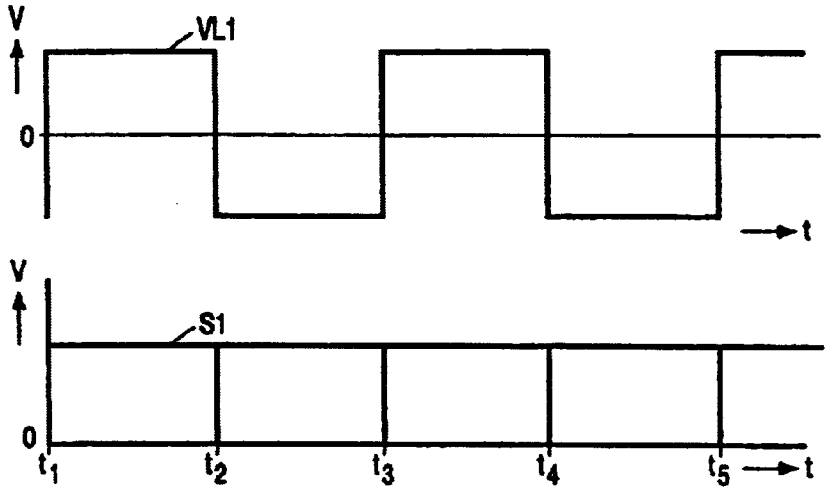
FIG. 2 shows a voltage diagram of voltages at nominal operation.
Figure 3:
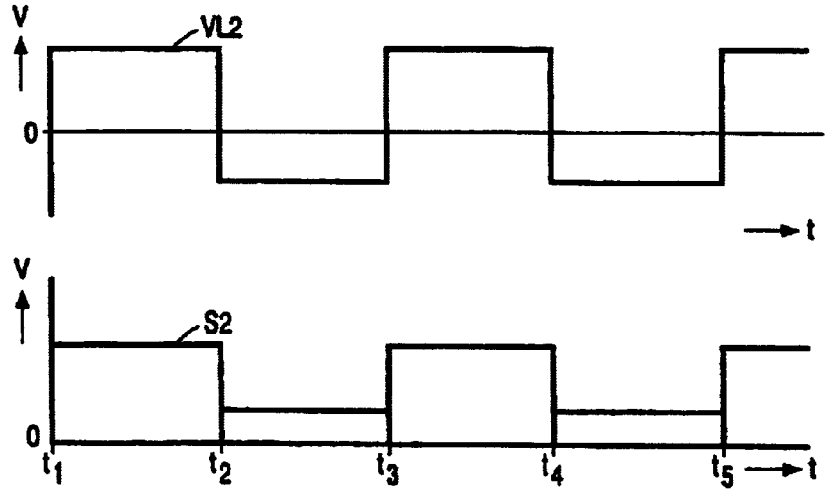
FIG. 3 shows a voltage diagram of voltages at Direct current operation, and FIG. 4 diagrammatically shows an algorithm used in the switching device in accordance with FIG. 1.

In FIG. 2 and FIG. 3, the time is plotted along the horizontal axis and a voltage is plotted along the vertical axis. In the voltage diagram shown in FIG. 2, VL1 shows the variation of the voltage across the connected lamp if asymmetric operation of the lamp does not take place. At the instants t1, t2, t3, t4 and t5, commutation of the commutator takes place, causing the voltage to have successive periods of opposite polarity. Thus, the intervals between t1 and t2 and between t3 and t4 form periods having a positive polarity, while the intervals between t2 and t3 and between t4 and t5 are periods of negative polarity. The periodical voltage detection by the means VD results in the formation of a lamp signal having a variation in accordance with S1.

In FIG. 3, VL2 forms, in a similar manner, the variation of the voltage across the connected lamp if asymmetric operation of the lamp takes place, in which case a direct current flows through the lamp or a DC voltage is applied across the lamp. In this case, the shape of the lamp signal of the voltage detection corresponds to S2.

Figure 4:
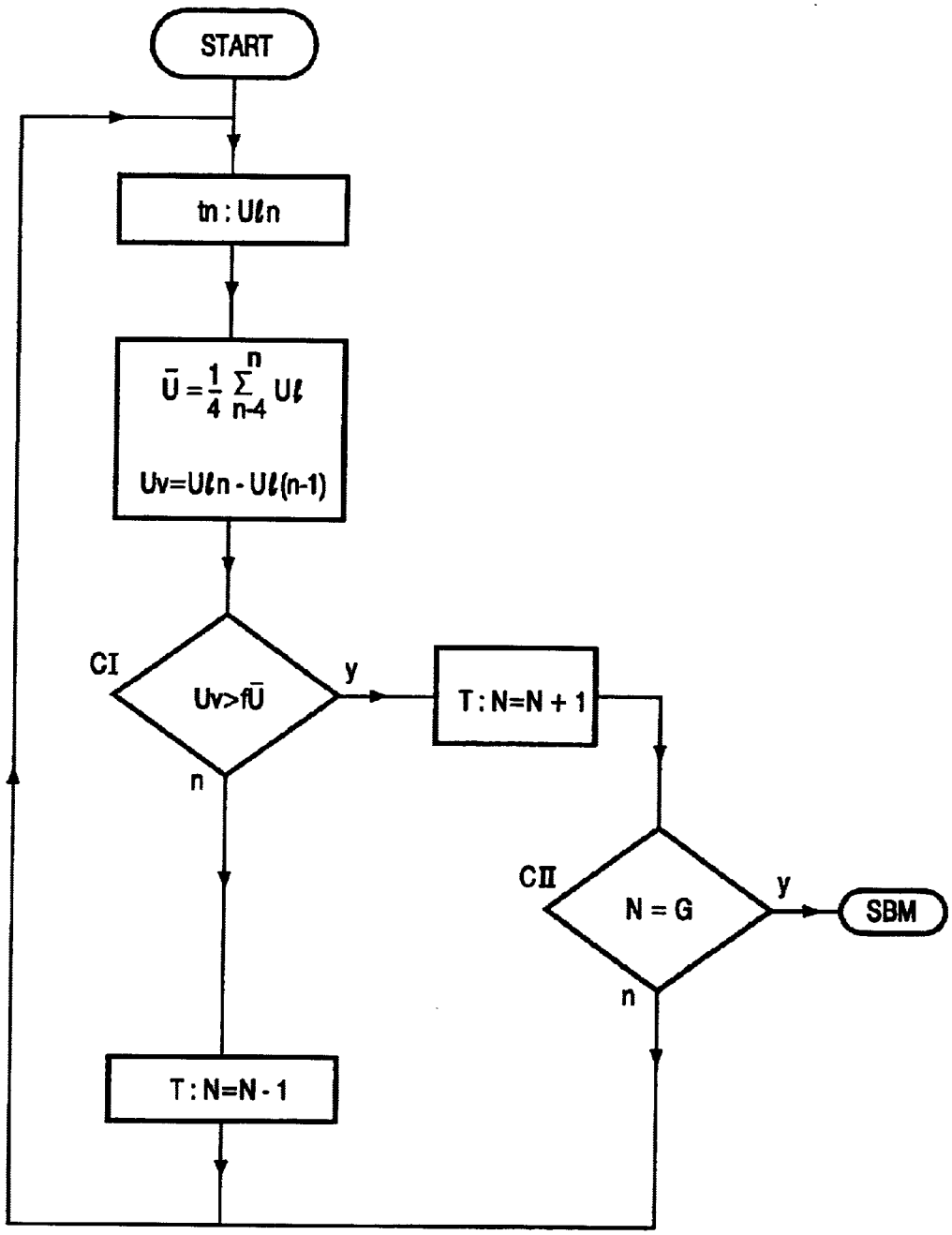

The algorithm with which the programmable IC of the example described herein is provided is diagrammatically shown in FIG. 4. After the lamp has been ignited and a stable burning condition has been achieved, indicated by means of START, at instant tn voltage detection takes place, the outcome of which is indicated by means of Uln. Subsequently, an average voltage $\overline{U}$ is calculated from the last 4 results Uln through Ul(n−4), and the difference in voltage between Uln and Ul(n−1) is calculated. Subsequently, comparison means carry out a comparison CI to determine whether the difference in voltage Uv exceeds a fraction f, for example 50%, of the average voltage $\overline{U}$. If so, a counting register T is increased by 1. In a next comparison CII, it is subsequently determined whether the contents of the counting register has reached a limiting value G. If so, the switch mode power supply is switched into a standby mode SBM. If not, a subsequent voltage detection is carried out. If the comparison CI reveals that Uv is smaller than or equal to the fraction f of the average voltage $\overline{U}$, then the contents of the counting register T is reduced by 1 and a subsequent voltage detection is carried out.

The example described herein forms part of a projection system, in particular a light valve projector.

What is claimed is:

1. A switching device for operating a high-pressure discharge lamp comprising:

input terminals for connecting a power supply source, output terminals for connecting the lamp to be operated, means including a switch mode power supply for supplying the output terminals with a voltage having successive periods of opposite polarity, control means for controlling the switch mode power supply, means for forming a lamp signal determined by lamp voltage, and means for detecting a direct current through or a DC voltage across the high-pressure discharge lamp.

2. The switching device as claimed in claim 1, characterized in that the detection of the direct current through or the DC voltage across the high-pressure discharge lamp takes place via the lamp signal.

3. The switching device as claimed in claim 2, characterized in that the switching device includes a commutator coupled between the switch mode power supply and the output terminals, and the formation of the lamp signal occurs via a coupling to a circuit point between the output of the switch mode power supply and the commutator.

4. The switching device as claimed in claim 1, characterized in that the formation of the lamp signal occurs by time-sequential voltage detections, and the means for carrying out the detection includes comparison means for comparing successive voltage detections with each other.

5. The switching device as claimed in claim 4, characterized in that the comparison means establishes a voltage difference between the successive voltage detections.

6. The switching device as claimed in claim 5, characterized in that the detection means is used to carry out an algorithm wherein, after each voltage detection, a counting register is controlled on the basis of an outcome of a comparison between an established voltage difference and an average voltage and, upon the counting register exceeding a threshold value, a control signal is generated for switching the switch mode power supply to a stand-by mode.

7. A switching device as claimed in claim 6, characterized in that the average voltage is formed from a moving average of voltage detections in a number of successive periods of opposite polarity, and the counting register is increased by one if the established voltage difference exceeds 50% of the average voltage.

8. The switching device as claimed in claim 6, characterized in that the average voltage is formed from a moving average of voltage detections in a number of successive periods of opposite polarity, and the counting register is reduced by one if the established voltage difference is equal to or smaller than 50% of the average voltage.

9. The switching device as claimed in claim 4 further comprising a counting register controlled on the basis of the successive voltage detections, wherein a particular count in the counting register indicates an occurrence of asymmetric operation of the discharge lamp.

10. The switching device as claimed in claim 9 wherein an average voltage is formed from a moving average of voltage detections in a number of successive periods of opposite polarity, and the counting register is incremented or decremented as a function thereof.

11. The switching device as claimed in claim 1, characterized in that the formation of the lamp signal occurs by time-sequential voltage detections, and the successive voltage detections take place via voltage detection in each period of the successive periods of opposite polarity.

12. A switching device as claimed in claim 11, characterized in that an average voltage is formed from a moving average of voltage detections in the last 4 successive periods of opposite polarity.

13. The switching device as claimed in claim 11 further comprising a counting register controlled on the basis of the successive voltage detections, wherein a particular count in the counting register indicates an occurrence of asymmetric operation of the discharge lamp and the counting register is operative to generate a control signal for switching the switch mode power supply to a given state when the particular count occurs in the counting register.

14. A projection apparatus comprising: the switching device as claimed in claim 1, and means for coupling the switching device to operate a high-pressure discharge lamp of the projection apparatus.

15. The switching device as claimed in claim 1 further comprising a commutator coupled in cascade with the switch mode power supply between the input terminals and the output terminals, and means coupling an output of the control means to the commutator so that the control means also controls the operation of the commutator.

16. The switching device as claimed in claim 1 wherein, upon detection of the direct current through or the DC voltage across the high pressure discharge lamp, the detecting means signals the control means to apply a control signal to the switch mode power supply to change the operating state thereof.

17. The switching device as claimed in claim 1 further comprising: means for applying to the output terminals the voltage having successive periods of opposite polarity, and wherein the detection of the direct current through or the DC voltage across the high pressure discharge lamp is indicative of asymmetric operation of the discharge lamp.

18. The switching device as claimed in claim 1 wherein the control means is controlled by the lamp signal independently of the power supplied to a discharge lamp when such lamp is connected to the output terminals.

19. The switching device as claimed in claim 1 further comprising means, coupled between the switched mode power supply and the output terminals, for applying to the output terminals the voltage having successive periods of opposite polarity.

20. The switching device as claimed in claim 19 wherein the lamp signal forming means is coupled to a circuit point between the switched mode power supply and at least one of said output terminals so that the lamp signal is determined at least in part by the direct current through or the direct voltage across the discharge lamp, and which is indicative of asymmetric operation of the discharge lamp.

21. The switching device as claimed in claim 1 further comprising a DC/AC commutator coupled in cascade with the switch mode power supply between the input terminals and the output terminals so as to apply the voltage having successive periods of opposite polarity to the output terminals.

22. The switching device as claimed in claim 1 wherein the voltage having successive periods of opposite polarity is an alternating voltage, and the means for supplying the alternating voltage to the output terminals is coupled in cascade with the switched mode power supply between the input terminals and the output terminals.

23. A method of operating a high pressure discharge lamp comprising:

applying an alternating voltage to the high pressure discharge lamp, detecting a direct current through or a DC voltage across the high pressure discharge lamp, and deriving a lamp signal which is determined by the results of the detecting step.

24. The operating method as claimed in claim 23 which further comprises:

controlling the alternating voltage to the high pressure discharge lamp as a function of the lamp signal.

25. The operating method as claimed in claim 24 wherein the lamp signal is produced by a direct current through or a DC voltage across the high pressure discharge lamp and which is caused by asymmetric operation of the discharge lamp.

26. A switching device for operating a high pressure discharge lamp with an alternating voltage, comprising:

input terminals for connection to a source of AC supply voltage, output terminals for connection to the discharge lamp, a switched mode power supply coupled to the input terminals, a DC/AC converter coupled between the switched mode power supply and the output terminals so as to apply the alternating voltage to the output terminals, means for deriving a lamp signal determined by lamp voltage, means responsible to the lamps signal for detecting a DC electric parameter related to one of lamp current and the lamp voltage, and control means responsive to the lamp signal for controlling the switched mode power supply.

* * * * *